US005858934A

United States Patent [19]

Wiggins et al.

[11] Patent Number: 5,858,934

[45] **Date of Patent: *Jan. 12, 1999**

[54] ENHANCED BIODEGRADABLE VEGETABLE OIL GREASE

[75] Inventors: Gary W. Wiggins, Willowick, Ohio; Kasturi Lal, Gurgaon, India

[73] Assignee: The Lubrizol Corporation, Wickliffe, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 646,840

[22] Filed: May 8, 1996

[51] Int. Cl.[6] ..... C10M 141/00

[52] U.S. Cl. ..... 508/486; 508/487; 508/488; 508/489; 508/490; 508/491

[58] Field of Search ..... 508/486, 488, 508/491

[56] References Cited

U.S. PATENT DOCUMENTS

| | | | |
|---|---|---|---|
| 2,697,693 | 12/1954 | Browning et al. | 252/41 |
| 2,824,066 | 2/1958 | Musselman et al. | 252/42.1 |
| 4,303,538 | 12/1981 | Pratt et al. | 252/37.7 |
| 4,392,967 | 7/1983 | Alexander | 252/41 |
| 4,627,192 | 12/1986 | Fick | 47/58 |
| 4,743,402 | 5/1988 | Fick | 260/412.2 |
| 5,116,522 | 5/1992 | Brown et al. | 252/18 |
| 5,154,593 | 9/1992 | Takashima | 508/488 |
| 5,154,840 | 10/1992 | Drake et al. | 252/21 |
| 5,256,321 | 10/1993 | Todd | 252/30.007 |
| 5,338,471 | 8/1994 | Lal | 508/491 |
| 5,413,725 | 5/1995 | Lal et al. | 508/491 |
| 5,427,700 | 6/1995 | Stoffa | 508/491 |
| 5,538,654 | 7/1996 | Lawate et al. | 508/486 |
| 5,595,965 | 1/1997 | Wiggins | 508/491 |

*Primary Examiner*—Eellen M. McAvoy
*Attorney, Agent, or Firm*—James L. Cordek; Joseph P. Fischer

[57] ABSTRACT

An enhanced biodegradable grease composition that is environmentally friendly, as well as several processes for preparing the grease composition is described which comprises (A) a base oil wherein the base oil is a natural oil or synthetic triglyceride of the formula

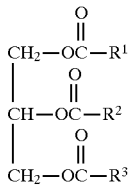

wherein $R^1$, $R^2$ and $R^3$ are aliphatic groups that contain from about 7 to about 23 carbon atoms;

(B) at least one performance additive comprising
(1) an alkyl phenol,
(2) a benzotriazole, or
(3) an aromatic amine; and (C) a thickener wherein the thickener (C) is a reaction product of (C1) a metal based material and (C2) a carboxylic acid or its ester.

The enhanced biodegradable lubricating grease may also contain (D) a viscosity modifier, (E) a pour point depressant, or mixtures of (D) and (E).

25 Claims, No Drawings

ENHANCED BIODEGRADABLE VEGETABLE OIL GREASE

FIELD OF THE INVENTION

This invention relates to an environmentally friendly grease composition that is made from a vegetable oil containing antioxidants and viscosity modifiers and a process for preparing the same. Antioxidants and metal passivators in the vegetable oil give rise to an enhanced vegetable oil. The grease composition is a mineral oil free grease. A thickener is prepared in situ within the enhanced vegetable oil wherein the thickener is an alkali or alkaline earth metal carboxylate.

BACKGROUND OF THE INVENTION

Grease manufacturers have attempted to prepare alkali and alkaline earth metal greases from enhanced vegetable oils with limited success. The high temperatures required degrade the vegetable oil thickener substitute and vegetable oil diluent. Further, high temperatures cause the antioxidants and viscosity modifiers to separate out.

U.S. Pat. No. 2,697,693 (Browning et al., Dec. 21, 1954) relates to improvements in the manufacture of lithium soap greases. More particularly, it relates to improvements in the manufacture of greases comprising lithium 12-hydroxy stearate or the lithium soap of hydrogenated castor oil and a lubricant base such as a mineral lubricating oil or the like.

U.S. Pat. No. 2,824,066 (Musselman et al., Feb. 18, 1958) relates to a multi-purpose soda base lubricating grease. The preparation of the grease preferably involves the in situ formation of a fatty acid soap in a mineral oil. A typical preparation comprises weighing the solvent-extracted oil and a calculated amount of sodium hydroxide into a mixing vessel and then heating these materials to an elevated temperature, generally in excess of 150° F., and a calculated amount of fatty acid is then weighted into the mixer. The mixer is again started and heating is continued at a temperature of approximately 300° F. After heating at the elevated temperature for about 10 to 15 minutes, until saponification is complete, an additional quantity of solvent-extracted oil is added to the mixer and heating is continued until a total processing time of about 2½ to 3 hours has elapsed. Heating is then discontinued and during the cooling of the crude grease mixture, an additional calculated quantity of solvent-extracted oil is added with the final oil addition being made at a temperature in the neighborhood of 225° to 230° F. Cooling is then continued until the grease is at a temperature suitable for packaging.

U.S. Pat. No. 4,303,538 (Pratt et al., Dec. 1, 1981) relates to oxyaluminum acylates containing more than about 75 mole percent of an aromatic carboxylic acid, but less than about 95 mole percent of aromatic acid which can be prepared, and, further, that such oxyaluminum acylates can be used to make aluminum complex grease of seemingly excellent quality. The greases made from such oxyaluminum acylates are produced without the use of water and without the production of water or alcohol as by-products.

U.S. Pat. No. 4,392,967 (Alexander, Jul. 12, 1983) is directed to a process for continuously manufacturing a lubricating grease using a screw process unit. More particularly, the process of this reference comprises:

(a) introducing feed materials and lubricating oil into selected locations of a screw process unit which contains a series of adjacent, longitudinally connected barrel sections for performing different operative steps and houses a rotating screw device traversing the interior to the barrel sections and having separate elements along its length to perform desired operations;

(b) mixing and conveying said feed materials along said process unit through the adjacent barrel sections by continuous operation of said rotating screw;

(c) controlling the temperature of said material while it is being conveyed through said process unit by use of various heat exchange means which are located in or adjacent to each barrel to aid in carrying out the operative steps of dispersion, reaction, dehydration and/or homogenization;

(d) venting water resulting from the dehydration of the feed mixture at selected barrel discharge points in said process unit;

(e) introduction of additional oil and/or additives at downstream barrel sections following the dehydration step;

(f) homogenization of said complete grease formulation by continued rotation of said screw device; and (g) removal of the finished lubricating grease from the end barrel section of said screw process unit.

U.S. Pat. No. 5,116,522 (Brown et al., May 26, 1992) concerns a lubricating composition having improved low temperature and high temperature properties. More specifically, a lubricating composition comprising (1) a lubricating oil, (2) a thickener, (3) a VI improver, and (4) a copolymer of ethylene with at least one compound selected from the group of vinyl acetate, alkyl acrylate, or alkyl methacrylate, has been found to have both excellent high temperature adhesiveness and low temperature slumpability. The ethylene copolymer used in this invention must have a Melt Index of at least about 40 g/10 min. and should contain from about 10 to about 40 wt. % vinyl acetate, alkyl acrylate, or alkyl methacrylate. Preferably, the Melt Index should be between about 40 and about 10,000, more preferably between about 40 and about 5,000, and most preferably between about 40 and about 2,500 g/10 mins.

U.S. Pat. No. 5,154,840 (Drake et al., Oct. 13, 1992) provides an environmentally friendly grease composition. The base components of this lubricating composition include a white mineral oil in the amount of about 65 to about 85% by weight based on total weight of the composition, an extreme pressure additive comprising a solid friction modifier in an amount of about 1 to about 20 wt. %, a thickener and a minor amount of one or more oil dispersible additives in amounts sufficient to enhance the performance characteristics of the greases. Each of the extreme pressure additive, thickener, and the one or more oil dispersible additives is essentially free of heavy metals, particularly arsenic, antimony, barium, cadmium, chromium, copper, iron, lead, mercury, molybdenum, nickel, selenium, vanadium and zinc.

U.S. Pat. No. 5,256,321 (Todd, Oct. 26, 1993) relates to improved grease compositions substantially free of boron and boron-containing compounds, comprising a major amount of an oil-based simple metal soap thickened base grease and a minor amount of at least one phosphorus and sulfur containing composition sufficient to increase the dropping point of the base grease, as determined by ASTM procedure D-2265, by at least 30° C.

SUMMARY OF THE INVENTION

An enhanced biodegradable lubricating grease is disclosed, which comprises (A) a base oil wherein the base oil is a natural oil or synthetic triglyceride of the formula

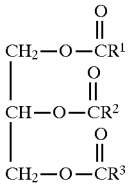

wherein $R^1$, $R^2$ and $R^3$ are aliphatic groups that contain from about 7 to about 23 carbon atoms;

(B) at least one performance additive comprising (1) an alkyl phenol of the formula

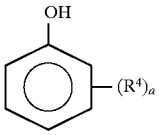

wherein $R^4$ is an alkyl group containing from 1 up to about 24 carbon atoms and a is an integer of from 1 up to 5;

(2) a benzotriazole of the formula

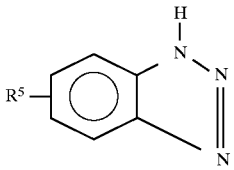

wherein $R^5$ is hydrogen or an alkyl group of 1 up to about 24 carbon atoms; or (3) an aromatic amine of the formula

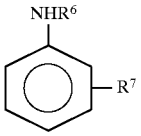

wherein $R^6$ is

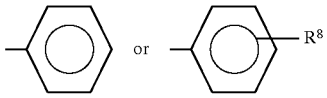

and $R^7$ and $R^8$ are independently a hydrogen or an alkyl group containing from 1 up to about 24 carbon atoms; and (C) a thickener wherein the thickener (C) is a reaction product of (C1) a metal based material and (C2) a carboxylic acid or its ester, wherein the metal based material (C1) comprises a metal oxide, metal hydroxide, metal carbonate or metal bicarbonate, wherein the metal is an alkali or alkaline earth metal and wherein the carboxylic acid (C2) is of the formula $R^{18}(COOR^{19})_n$ wherein $R^{18}$ is an aliphatic group that contains from 4 to 29 carbon atoms, $R^{19}$ is hydrogen or an aliphatic group that contain from 1 to 4 carbon atoms and n is an integer of from 1 to 4.

The enhanced biodegradable lubricating grease may also contain (D) a viscosity modifier, (E) a pour point depressant, or mixtures of (D) and (E).

Also disclosed are several processes for preparing an enhanced biodegradable lubricating grease, comprising the steps of (a) making a solution of (A) and (B) or (A), (B), (D) and/or (E) with (C1) and (C2), thereby providing a mixture;

(b) heating said mixture to a temperature of from 82° to about 105° C. to form (C);

(c) heating the mixture to a final temperature of about 145° C. for an alkaline metal or to about 200° C. for an alkali metal; and (d) cooling the mixture to form a grease.

In another process embodiment, the enhanced biodegradable lubricating grease is prepared, comprising the steps of (a) making a solution of (A) and (B) or (A), (B), (D) and/or (E) with (C1) and (C2), thereby providing a first mixture;

(b) heating said first mixture to a temperature of from 82° to about 105° C. to form (C) thereby providing a first heated mixture;

(c) heating the first heated mixture to a final temperature of about 145° C. for an alkaline metal or to about 200° C. for an alkali metal;

(d) adding at 110°–145° C. for an alkaline earth metal or 170°–200° C. for an alkali metal, subsequent portions of (A) or the solution of (A) and (B) or (A), (B), (D) and/or (E) to provide a second mixture; and (e) permitting this mixture to cool to form a grease.

In the above processes, components (A), (B), (C1), (C2), (D) and (E) are as earlier defined.

DETAILED DESCRIPTION OF THE INVENTION (A) The Base Oil

In practicing this invention, the base oil is a synthetic triglyceride or a natural oil of the formula

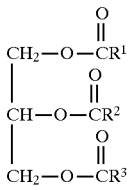

wherein $R^1$, $R^2$ and $R^3$ are aliphatic hydrocarbyl groups that contain from about 7 to about 23 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Naturally occurring triglycerides are vegetable oil triglycerides. The synthetic triglycerides are those formed by the reaction of one mole of glycerol with three moles of a fatty acid or mixture of fatty acids. In preparing a synthetic triglyceride, the fatty acid contains from 8 to 24 carbon atoms. Preferably the fatty acid is oleic acid, linoleic acid, linolenic acid or mixtures thereof. Most preferably, the fatty acid is oleic acid. Of the vegetable oil triglycerides and the synthetic triglycerides, preferred are vegetable oil triglycerides. The preferred vegetable oils are soybean oil, rapeseed oil, sunflower oil, coconut oil, lesquerella oil, canola oil, peanut oil, safflower oil and castor oil.

In a preferred embodiment, the aliphatic hydrocarbyl groups are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$ and $R^3$ groups are heptadecenyl groups and the $R^1COO^-$, $R^2COO^-$ and $R^3COO^-$ to the 1,2,3-propanetriyl group —$CH_2CHCH_2$— are the residue of an oleic acid molecule. U.S. Pat. Nos. 4,627,192 and 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic acid, the monounsaturated content is 70%. The preferred triglyceride oils are high oleic acid, that is, genetically modified vegetable oils (at least 60 percent) triglyceride oils. Typical high oleic vegetable oils employed within the instant invention are high oleic safflower oil, high oleic canola oil, high oleic peanut oil, high oleic corn oil, high oleic rapeseed oil, high oleic sunflower oil and high oleic soybean oil. Canola oil is a variety of rapeseed oil containing less than 1 percent erucic acid. A preferred high oleic vegetable oil is high oleic sunflower oil obtained from *Helianthus sp.* This product is available from SVO Enterprises Eastlake, Ohio as Sunyl® high oleic sunflower oil. Sunyl 80 is a high oleic triglyceride wherein the acid moieties comprise 80 percent oleic acid. Another preferred high oleic vegetable oil is high oleic rapeseed oil obtained from *Brassica campestris* or *Brassica napus*, also available from SVO Enterprises as RS high oleic rapeseed oil. RS80 oil signifies a rapeseed oil wherein the acid moieties comprise 80 percent oleic acid.

It is further to be noted that genetically modified vegetable oils have high oleic acid contents at the expense of the di- and tri- unsaturated acids. A normal sunflower oil has from 20–40 percent oleic acid moieties and from 50–70 percent linoleic acid moieties. This gives a 90 percent content of mono- and di- unsaturated acid moieties (20+70) or (40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

In another embodiment, the genetically modified vegetable oil can be sulfurized. While the sulfurization of compounds containing double bonds is old in the art, the sulfurization of a genetically modified vegetable oil must be done in a maimer that total vulcanization does not occur. A direct sulfurization done by reacting the genetically modified vegetable oil with sulfur will give a vulcanized product wherein if the product is not solid, it would have an extremely high viscosity. This would not be a suitable base oil (A) for the preparation of a grease. Other methods of sulfurization are known to those skilled in the art. A few of these sulfurization methods are sulfur monochloride; sulfur dichloride; sodium sulfide/$H_2S$/sulfur; sodium sulfide/$H_2S$; sodium sulfide/sodium mercaptide/sulfur and sulfurization utilizing a chain transfer agent. A particularly preferred sulfurized genetically modified vegetable oil is a sulfurized Sunyl 80® oil available from Hornett Brothers.

The sulfurized genetically modified vegetable oil has a sulfur level generally from 5 to 15 percent by weight, preferably from 7 to 13 percent by weight and most preferably from 8.5 to 11.5 percent by weight.

Utilizing a sulfurized genetically modified vegetable oil as component (A) is a way to prepare a grease having additional antiwear or load carrying abilities.

Component (A) may be all genetically modified vegetable oil, all sulfurized genetically modified vegetable oil or a mixture of sulfurized genetically modified vegetable oil and genetically modified vegetable oil. When a mixture is employed, the ratio of genetically modified vegetable oil to sulfurized genetically modified vegetable oil is from 85:15 to 15:85.

(B) The Performance Additive

The base oil (A) is enhanced with a performance additive (B). The performance enhanced by these additives is in the areas of anti-wear, oxidation inhibition, rust/corrosion inhibition, metal passivation, extreme pressure, friction modification, and the like.

The performance additive (B) is selected from the group consisting of (1) an alkyl phenol, (2) a benzotriazole, and (3) an aromatic amine.

(B1) The Alkyl Phenol

Component (B1) is an alkyl phenol of the formula

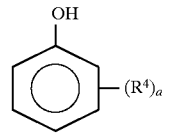

wherein $R^4$ is an alkyl group containing from 1 up to about 24 carbon atoms and a is an integer of from 1 up to 5. Preferably $R^4$ contains from 4 to 18 carbon atoms and most preferably from 4 to 12 carbon atoms. $R^4$ may be either straight chained or branched chained and branched chained is preferred. The preferred value for a is an integer of from 1 to 4 and most preferred is from 1 to 3. An especially preferred value for a is 2. When a is not 5, it is preferred that the position para to the OH group be open.

Mixtures of alkyl phenols may be employed. Preferably the phenol is a butyl substituted phenol containing 2 or 3 t-butyl groups. When a is 2, the t-butyl groups occupy the 2,6-position, that is, the phenol is sterically hindered:

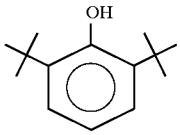

When a is 3, the t-butyl groups occupy the 2,4,6-position.

(B2) The Benzotriazole

The benzotriazole compound of the formula

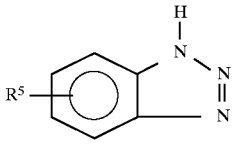

wherein $R^5$ is hydrogen a straight or branched-chain alkyl group containing from 1 up to about 24 carbon atoms, preferably I to 12 carbon atoms and most preferably 1 carbon atom. When $R^5$ is 1 carbon atom the benzotriazole compound is tolyltriazole of the formula

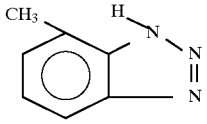

Tolyltriazole is available under the trade name Cobratec TT-100 from Sherwin-Williams Chemical.

(B3) The Aromatic Amine

Component (B3) is at least one aromatic amine of the formula

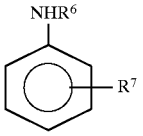

wherein $R^6$ is

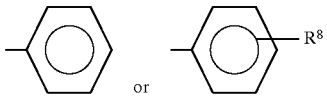

and $R^7$ and $R^8$ are independently a hydrogen or an alkyl group containing from 1 up to 24 carbon atoms. Preferably $R^6$ is

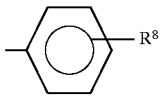

and $R^7$ and $R^8$ are alkyl groups containing from 4 up to about 18 carbon atoms. In a particularly advantageous embodiment, component (B3) comprises alkylated diphenylamine such as nonylated diphenylamine of the formula

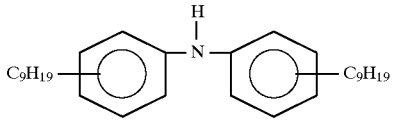

(C) The Thickener

The thickener is a metal salt formed by the reaction of (C1) a metal based material and (C2) a carboxylic acid or its ester.

(C1) The Metal Based Material

The metal based material (C1) is a metal oxide, metal hydroxide, metal carbonate or metal bicarbonate. Preferred are metal hydroxides. The metal is an alkali or an alkaline earth metal. Alkali metals of interest are lithium, sodium and potassium. The alkaline earth metals of interest are magnesium, calcium and barium. The preferred metal hydroxides are lithium hydroxide and calcium hydroxide.

(C2) The Carboxylic Acid or Its Ester

The carboxylic acid (C2) is of the formula $R^{18}(COOR^{19})_n$ wherein $R^{18}$ is an aliphatic or hydroxy substituted aliphatic group that contains from 4 to 29 carbon atoms, $R^{19}$ is hydrogen or an aliphatic group containing from 1 to 4 carbon atoms and n is an integer of from 1 to 4. When $R^{18}$ is an aliphatic group, preferably $R^{18}$ contains from 12 to 24 carbon atoms and n is 1 or 2. A nonexhaustive but illustrative list of these aliphatic groups is as follows: the isomeric heptyls, the isomeric heptenyls, the isomeric octyls and octenyls, the isomeric nonyls and nonenyls, the isomeric dodecyls and dodecenyls, the isomeric undecyls and undecenyls, the isomeric tridecyls and tridecenyls, the isomeric pentadecyls and pentadecenyls, the isomeric heptadeceyls and heptadecenyls and the isomeric nonadecyls and nonadecenyls. When $R^{18}$ and $R^{19}$ are both aliphatic groups, $R^{19}$ preferably is a methyl group. When $R^{18}$ is an aliphatic group, $R^{19}$ is hydrogen and n is 1, the preferred carboxylic acids are caprylic acid, capric acid, lauric acid, myristic acid, palmitic acid, stearic acid and oleic acid. When $R^{18}$ is an aliphatic group and n is 2, the preferred dicarboxylic acids are azelaic acid and sebacic acid.

The $R^{18}$ group may also be a mono-hydroxy substituted or di-hydroxy substituted aliphatic group. When $R^{18}$ is a mono-hydroxy substituted or di-hydroxy substituted aliphatic group and $R^{19}$ is hydrogen, it is preferred that n be equal to 1. This then gives rise to mono-hydroxy or di-hydroxy substituted mono-carboxylic acids. The preferred mono-hydroxy substituted aliphatic monocarboxylic acids are 6-hydroxystearic acid, 12-hydroxystearic acid, 14-hydroxystearic acid, 16-hydroxystearic acid, ricinoleic acid, and 14-hydroxy-11-eicosenoic acid. The preferred di-hydroxy substituted monocarboxylic acid is 9,10-dihydroxy-stearic acid.

The reaction of the metal based material (C1) with the carboxylic acid or its ester (C2) to form the thickener (C) is conducted in a solution of base oil (A) and the performance additive (B). The equivalent ratio of (C1):(C2) is from about 1:0.70–1.10 and the weight ratio of the base oil to the sum of the metal based material and the carboxylic acid is from 50:50 to 95:5.

The enhanced grease composition of this invention, components (A), (B) and (C), may further comprise (D) a viscosity modifier, (E) a pour point depressant, or mixtures of (D) and (E).

(D) The Viscosity Modifier

The viscosity modifier (D) is a hydrogenated block copolymer. It comprises either a normal block copolymer, that is a true block copolymer or a random block copolymer. Considering the true or normal block copolymer, it is generally made from conjugated dienes having from 4 to 10 carbon atoms and preferably from 4 to 6 carbon atoms as well as from vinyl substituted aromatics having from 8 to 12 carbon atoms and preferably 8 or 9 carbon atoms.

Examples of vinyl substituted aromatics include styrene, alpha-methylstyrene, ortho-methylstyrene, meta-methylstyrene, para-methylstryrene, para-tertiary-butylstyrene, with styrene being preferred. Examples of such conjugated dienes include piperylene, 2, 3-dimethyl-1, 3-butadiene, chloroprene, isoprene and 1, 3-butadiene with isoprene and 1, 3-butadiene being particularly preferred. Mixtures of such conjugated dienes are useful.

The normal block copolymers have a total of from 2 to about 5, and preferably 2 or 3, polymer blocks of the vinyl substituted aromatic and the conjugated diene with at least one polymer block of said vinyl substituted aromatic and at least one polymer block of said conjugated dienes being present. The conjugated diene block is hydrogenated as more fully set forth hereinbelow. The normal block copolymers can be linear block copolymers wherein a substantially long sequence of one monomeric unit (Block I) is linked with another substantially long sequence of a second (Block II), third (Block III), fourth (Block IV), or fifth (Block V) monomeric unit. For example, if a is a styrene monomeric unit and d is a conjugated diene monomeric unit, a tri-block copolymer of these monomeric unit can be represented by the formula:

aaaa - - · aa — ddd - - · ddd — aaa - - · aa

Block I Block II Block III

Linear A B A Block

These copolymers can also be radial block copolymers wherein the polymer blocks are linked radically as represented by the formula:

aaa - - · aa - - · aa - - · aaa
|
ddd - - · ddd

Radial A B Block

In practice, the number of repeat units involved in each polymer block usually exceeds about 500, but it can be less than about 500. The sequence length in one block should be long enough so that the block copolymer exhibits the inherent homopolymeric physical properties such as glass transition temperature and polymer melt temperature.

The vinyl substituted aromatic content of these copolymers, that is the total amount of vinyl substituted aromatic blocks in the normal block copolymer, is in the range of from about 20 percent to about 70 percent by weight and preferably from about 40 percent to about 60 percent by weight. Thus, the aliphatic conjugated diene content, that is the total diene block content, of these copolymers is in the range of from about 30 percent to about 80 percent by weight and preferably from about 40 percent to about 60 percent by weight.

These normal block copolymers can be prepared by conventional methods well known in the art. Such copolymers usually are prepared by anionic polymerization using, for example, an alkali metal hydrocarbon (e.g., sec-butyllithium) as a polymerization catalyst.

Examples of suitable normal block copolymers as set forth above include Shellvis-40 and Shellvis-50, both hydrogenated styrene-isoprene block copolymers, manufactured by Shell Chemicals.

Considering the random block copolymer which can be utilized separately, in combinations with the normal block copolymers set forth above, or not at all, it is generally defined as a block copolymer having one or more block polymer portions therein. More specifically, the random block copolymers can be defined as an indeterminate number of a and d blocks of indeterminate lengths. These random copolymers are generally made from conjugated dienes of the type noted above and hereby incorporated by reference with butadiene or isoprene being preferred. The remaining monomer utilized to make the random block copolymer comprises vinyl substituted aromatics of the type set forth hereinabove and are also hereby fully incorporated by reference. A suitable type of aromatic monomer is styrene. The random block copolymer can be made by simultaneously feeding a mixture of monomers to a polymerization system rather than by feeding the monomers in a sequential manner. The amount of the various blocks by weight are the same as set forth above, that is from about 20 to about 70 percent by weight of vinyl substituted aromatic block with 40 to 60 percent by weight of such blocks being preferred. Accordingly, the amount of the diene blocks is the difference. The number average molecular weight and the weight average molecular weight of the random block copolymers are the same as set forth above and accordingly are hereby fully incorporated by reference. The random block copolymers contain significant blocks of a vinyl substituted aromatic repeating unit and/or significant blocks of a conjugated diene repeating unit therein and/or blocks of random or random tapered conjugated diene/vinyl substituted aromatic. These copolymers can also be represented as by A'-B'-A'-B'- wherein A' is a block of vinyl substituted aromatic compound. B'is a block of conjugated diene, and the length of A' and B' blocks vary widely and, are substantially shorter than the A and B blocks of a normal block copolymer. The amount of the aromatic A block content of the random block copolymer preferably should be in the range of about 15 to about 45, more preferably 25 to about 40 weight percent.

Examples of such commercially available random block copolymers include the various Glissoviscal block copolymers manufactured by BASF. A previously available random block copolymer was Phil-Ad viscosity improver, manufactured by Phillips Petroleum.

Regardless of whether a true (normal block) copolymer or a random block copolymer, or combinations of both are utilized, they are hydrogenated before use so as to remove virtually all of their olefinic double bonds. Techniques for accomplishing this hydrogenation are well know to those of skill in the art and need not be described in detail at this point. Briefly, hydrogenation is accomplished by contacting the copolymers with hydrogen at superatomospheric pressures in the presence of a metal catalyst such as colloidal nickel, palladium on charcoal, etc.

In general, it is preferred that these block copolymers, for reasons of oxidative stability, contain no more than about 5 percent and preferably no more than about 0.5 percent residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation as determined by the afore-mentioned analytical techniques.

The block copolymers typically have number average molecular weight in the range of about 5,000 to about 1,000,000 preferably about 30,000 to about 200,000. The weight average molecular weight for these copolymers is generally in the range of about 50,000 to about 500,000, preferably about 30,000 to about 300,000.

(E) The Pour Point Depressant

Pour point depressants (PPD) having utility in this invention are carboxy containing interpolymers in which many of the carboxy groups are esterified and the remaining carboxy groups, if any, are neutralized by reaction with amino compounds; acrylate polymers, nitrogen containing acrylate polymers, methylene linked aromatic compounds and terpolymers of a fumarate, vinyl ester and vinyl ether.

Carboxy-Containing Interpolymers

This PPD is an ester of a carboxy-containing interpolymer, said interpolymer having a reduced specific viscosity of from about 0.05 to about 2, and being derived from at least two monomers, one of said monomers being a low molecular weight aliphatic olefin, styrene or substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity, i.e., at least 90% esterification, and being characterized by the presence within its polymeric structure of pendant polar groups which are derived from the carboxy group of acid ester: (a) a relatively high molecular weight carboxylic ester group having at least 8 aliphatic carbon atoms in the ester radical, optionally (b) a relatively low molecular weight carboxylic ester group having no more than 7 aliphatic carbon atoms in the ester radical, and optionally (c) a carbonyl-polyamino group derived from a polyamino compound having one primary or secondary amino group, wherein the molar ratio of (a):(b) is (1–20):1, preferably (1–10):1 and wherein the molar ratio of (a):(b):(c) is (50–100):(5–50):(0.1–15)

In reference to the size of the ester groups, it is pointed out that an ester radical is represented by the formula

—C(O)(OR)

and that the number of carbon atoms in an ester radical is the combined total of the carbon atoms of the carbonyl group and the carbon atoms of the ester group i.e., the (OR) group.

An optional element of this ester is the presence of a polyamino group derived from a particular amino compound, i.e., one in which there is one primary or secondary amino group and at least one mono-functional amino group. Such polyamino groups, when present in this mixed ester in the proportion stated above enhances the dispensability of such esters in lubricant compositions and additive concentrates for lubricant compositions.

Still another essential element of the mixed ester is the extent of esterification in relation to the extent of neutralization of the unesterified carboxy groups of the carboxy-containing interpolymer through the conversion thereof to the optional polyamino-containing groups. For convenience, the relative proportions of the high molecular weight ester group to the low molecular weight ester group and to the polyamino group when these latter two components are utilized are expressed in terms of molar ratios of (50–100):(5–50):(0.1–15), respectively. The preferred ratio is (70–85):(15–30):(3–4). It should be noted that the linkage described as the carbonyl-polyamino group may be imide, amide, or amidine and inasmuch as any such linkage is contemplated within the present invention, the term "carbonyl polyamino" is thought to be a convenient, generic expression useful for the purpose of defining the inventive concept. In a particularly advantageous embodiment of the invention such linkage is imide or predominantly imide.

Still another important element of the mixed ester is the molecular weight of the carboxy-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 10 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, *Principles of Polymer Chemistry*, (1953 Edition) pages 308 et seq.

While interpolymers having reduced specific viscosity of from about 0.05 to about 2 are contemplated in the mixed ester, the preferred interpolymers are those having a reduced specific viscosity of from about 0.1 to about 1. In most instances, interpolymers having a reduced specific viscosity of from about 0.1 to about 0.8 are particularly preferred.

From the standpoint of utility, as well as for commercial and economical reasons, esters in which the high molecular weight ester group has from 8 to 24 aliphatic carbon atoms, the low molecular weight ester group has from 3 to 5 carbon atoms, and the carbonyl amino group is derived from a primary-aminoalkyl-substituted tertiary amine, particularly heterocyclic amines, are preferred. Specific examples of the high molecular weight carboxylic ester group, i.e., the (OR) group of the ester radical (i.e., —(O)(OR)) include heptyloxy, isooctyloxy, decyloxy, dodecyloxy, tridecyloxy, tetradecyloxy, pentadecyloxy, octadecyloxy, eicosyloxy, tricosyloxy, tetracosyloxy, etc. Specific examples of low molecular weight groups include methoxy, ethoxy, n-propyloxy, isopropyloxy, n-butyloxy, sec-butyloxy, isobutyloxy, n-pentyloxy, neo-pentyloxy, n-hexyloxy, cyclohexyloxy, xyxlopentyloxy, 2-methyl-butyl-1-oxy, 2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc.

Examples of the carbonyl polyamino group include those derived from polyamino compounds having one primary or secondary amino group and at least one mono-functional amino group such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenothiaznes, amidines, etc. Examples of such polyamino compounds include dimethylamino-ethylamine, dibutylamino-ethylamine, 3-dimethylamino-1-propylamine, 4-methylethylamino-1-butylamine, pyridyl-ethylamine, N-morpholino-ethylamine, tetrahydropyridylethylamine, bis-(dimethylamino)propyl-amine, bis-(diethylamino)ethylamine, N,N-dimethyl-p-phenylene diamine, piperidyl-ethylamine, 1-aminoethyl pyrazole, 1-(methylamino)pyrazoline, 1-methyl-4-amino-octyl pyrazole, 1-aminobutyl imidazole, 4-aminoethyl thiazole, 2-aminoethyl pyridine, ortho-amino-ethyl-N,N-dimethylbenzenesulfamide, N-aminoethyl phenothiazine, N-aminoethylacetamidine, 1 -aminophenyl-2-aminoethyl pyridine, N-methyl-N-aminoethyl-S-ethyl-dithiocarbamate, etc. Preferred polyamino compounds include the N-aminoalkyl-substituted morpholines such as aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzopyrroles, quinolines, pyrroles, etc. They are usually amines having from 4 to about 30 carbon atoms, preferably from 4 to about 12 carbon atoms. Polar substituents may likewise be present in the polyamines.

The carboxy-containing interpolymers include principally interpolymers of alpha, beta-unsaturated acids or anhydrides such as maleic anhydride or itaconic anhydride with olefins (aromatic or aliphatic) such as ethylene, propylene, isobutene or styrene, or substituted styrene wherein the substituent is a hydrocarbyl group containing from 1 up to about 18 carbon atoms. The styrene-maleic anhydride interpolymers are especially useful. They are obtained by polymerizing equal molar amounts of styrene and maleic anhydride, with or without one or more additional interpolymerizable comonomers. In lieu of styrene, an aliphatic olefin may be used, such as ethylene, propylene or isobutene. In lieu of maleic anhydride, acrylic acid or methacrylic acid or ester thereof may be used. Such interpolymers are know in the art and need not be described in detail here. Where an interpolymerizable comonomer is contemplated, it should be present in a relatively minor proportion, i.e., less that about 0.3 mole, usually less than about 0.15 mole, per mole of either the olefin (e.g. styrene) or the alpha, beta-unsaturated acid or anhydride (e.g. maleic anhydride). Various methods of interpolymerizing styrene and maleic anhydride are known in the art and need not be discussed in detail here. For purpose of illustration, the interpolymerizable comonomers include the vinyl monomers such as vinyl acetate, acrylonitrile, methylacrylate, methylmethacrylate, acrylic acid, vinyl methyl either, vinyl ethyl ether, vinyl chloride, isobutene or the like.

The nitrogen-containing esters of the mixed ester are most conveniently prepared by first 100 percent esterifying the carboxy-containing interpolymer with a relatively high molecular weight alcohol and a relatively low molecular weight alcohol. When the optional (c) is employed, the high molecular weight alcohol and low molecular weight alcohol are utilized to convert at least about 50% and no more than about 98% of the carboxy radicals of the interpolymer to ester radicals and then neutralizing the remaining carboxy radicals with a polyamino compound such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5:1. More than one high molecular weight alcohol or low molecular weight alcohol may be used in the process; so also may be used commercial alcohol mixtures such as the so-called Oxoalcohols which comprise, for example mixtures of alcohols having from 8 to about 24 carbon atoms. A particularly useful class of alcohols are the commercial alcohols or alcohol mixtures comprising decylalcohol, dodecyl alcohol, tridecyl alcohol, tetradecyl alcohol, pentadecyl alcohol, hexadecyl alcohol, heptadecyl alcohol and octadecyl alcohol. Other alcohols useful in the process are illustrated by those which, upon esterification, yield the ester groups exemplified above.

The extent of esterification, as indicated previously, may range from about 50% to about 98% conversion of the carboxy radicals of the interpolymer to ester radicals. In a preferred embodiment, the degree of esterification ranges from about 75% to about 95%.

The esterification can be accomplished simply be heating the carboxy-containing interpolymer and the alcohol or alcohols under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and a esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well know in the art.

A particularly desirable method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy radicals to ester radicals and then with the relatively low molecular weight alcohol to achieve the finally desired degree of esterification results in products which have unusually beneficial viscosity properties.

The esterified interpolymer may optionally be treated with a polyamino compound in an amount so as to neutralize substantially all of the unesterified carboxy radicals of the interpolymer. The neutralization is preferably carried out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the amino compound is often desirable, so as to insure substantial completion of neutralization, i.e., no more than about 2% of the carboxy radicals initially present in the interpolymer remained unneutralized.

The following examples are illustrative of the preparation of the mixed ester of the present invention. Unless otherwise indicated all parts and percentages are by weight.

EXAMPLE (E-1)

A styrene-maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42 part) in a similar benzene-toluene mixture (2.7 parts). The resulting product is a thick slurry of the interpolymer in the solvent mixture. To the slurry there is added mineral oil (141 parts) while the solvent mixture is being distilled off at 150° C. and then at 150° C./200 mm. Hg. To 209 parts of the stripped mineral oil-interpolymer slurry (the interpolymer having a reduced specific viscosity of 0.72) there are added toluene (25.2 parts), n-butyl alcohol (4.8 parts), a commercial alcohol consisting essentially of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). The mixture is then heated at 150°–160° C. for 20 hours whereupon water is distilled off. An additional amount of sulfuric acid (0.18 part) together with an additional amount of n-butyl alcohol (3 parts) is added and the esterification is continued until 95% of the carboxy radicals of the polymer has been esterified. To the esterified interpolymer, there is then added aminopropyl morpholine (3.71 parts; 10% in excess of the stoichiometric amount required to neutralize the remaining free carboxy radicals) and the resulting mixture is heated to 150°–160° C./10 mm. Hg to distill off toluene and any other volatile components. The stripped product is mixed with an additional amount of mineral oil (12 parts) filtered. The filtrate is a mineral oil solution of the nitrogen-containing mixed ester having a nitrogen content of 0.16–0.17%.

EXAMPLE (E-2)

The procedure of Example (E-1) is followed except that the esterification is carried out in two steps, the first step being the esterification of the styrene-maleic interpolymer with the commercial alcohols having from 8 to 18 carbon atoms and the second step being the further esterification of the interpolymer with n-butyl alcohol.

EXAMPLE (E-3)

The procedure of Example (E-1) is followed except that the esterification is carried out by first esterifying the styrene-maleic interpolymer with the commercial alcohol having from 8 to 18 carbon atoms until 70% of the carboxyl radicals of the interpolymer have been converted to ester radicals and thereupon continuing the esterification with any yet-unreacted commercial alcohols and n-butyl alcohol until 95% of the carbonyl radicals of the interpolymer have been converted to ester radicals.

EXAMPLE (E-4)

The procedure of Example (E-1) is followed except that the interpolymer is prepared by polymerizing a solution consisting of styrene (416 parts), maleic anhydride (392 parts), benzene (2153 parts) and toluene (5025 parts) in the presence of benzoyl peroxide (1.2 parts) at 65°–106° C. (The resulting interpolymer has a reduced specific viscosity of 0.45).

EXAMPLE (E-5)

The procedure of Example (E-1) is followed except that the styrene-maleic anhydride is obtained by polymerizing a mixture of styrene (416 parts), maleic anhydride (392 parts), benzene (6101 parts) and toluene (2310 parts) in the presence of benzoyl peroxide (1.2 parts) at 78°–92° C. (The resulting interpolymer has a reduced specific viscosity of 0.91).

EXAMPLE (E-6)

The procedure of Example (E-1) is followed except that the styrene-maleic anhydride is prepared by the following procedure: Maleic anhydride (392 parts) is dissolved in benzene (6870 parts). To this mixture there is added styrene (416 parts) at 76° C. whereupon benzoyl peroxide (1.2 parts) is added. The polymerization mixture is maintained at 80°–82° C. for about 5 hours. (The resulting interpolymer has a reduced specific viscosity of 1.24)

EXAMPLE (E-7)

The procedure of Example (E-1) is followed except that acetone (1340 parts) is used in place of benzene as the polymerization solvent and that azobisisobutyronitrile (0.3 part) is used in place of benzoyl peroxide as a polymerization catalyst.

EXAMPLE (E-8)

An interpolymer (0.86 carboxyl equivalent) of styrene and maleic anhydride (prepared from an equal molar mixture of styrene and maleic anhydride and having a reduced specific viscosity of 0.69) is mixed with mineral oil to form a slurry, and then esterified with a commercial alcohol mixture (0.77 mole; comprising primary alcohols having from 8 to 18 carbon atoms) at 150°–160° C. in the presence of a catalytic amount of sulfuric acid until about 70% of the carboxyl radicals are converted to ester radicals. The partially esterified interpolymer is then further esterified with a n-butyl alcohol (0.31 mole) until 95% of the carboxyl radicals of the interpolymer are converted to the mixed ester radicals. The esterified interpolymer is then treated with aminopropyl morpholine (slight excess of the stoichiometric amount to neutralize the free carboxyl radicals of the interpolymer) at 150°–160° C. until the resulting product is substantially neutral (acid number of 1 to phenolphthalein indicator). The resulting product is mixed with mineral oil so as to form an oil solution containing 34% of the polymeric product.

Examples (E-1) through (E-8) are prepared using mineral oil as the diluent. All of the mineral oil or a portion thereof may be replaced with the base oil (A) as is illustrated in Examples (E-9) to (E-11). The preferred triglyceride oil is the high oleic sunflower oil.

EXAMPLE (E-9)

Charged to a 12 liter 4 neck flask is 3621 parts of the interpolymer of Example (E-8) as a toluene slurry. The percent toluene is about 76 percent. Stirring is begun and 933 parts (4.3 equivalents) Alfol 1218 alcohol and 1370 parts xylene are added. The contents are heated and toluene is removed by distillation. Additional xylene is added in increments of 500, 500, 300 and 300 parts while continuing to remove toluene, the object being to replace the lower boiling toluene with the higher boiling xylene. The removal of solvent is stopped when the temperature of 140° C. is reached. The flask is then fitted with an addition funnel and the condenser is set to reflux. At 140° C., 23.6 parts (0.17 equivalents) methanesulfonic acid in 432 parts (3 equivalents) Alfol 810 alcohol is added in about 20 minutes. The contents are stirred overnight at reflux while collecting water in a Dean Stark trap. Then added is 185 parts (2.5 equivalents) of n-butanol containing therein 3.0 parts (0.02 equivalents) of methanesulfonic acid. This addition occurs over a 60 minute time period. The contents are maintained at reflux for 8 hours and then an additional 60 parts (0.8 equivalents) n-butanol is added and the contents are permitted to reflux overnight. At 142° C. is added 49.5 parts (0.34 equivalents) aminopropylmorpholine in 60 minutes. After a 2 hour reflux 13.6 parts (equivalents) 50% aqueous sodium hydroxide is added over 60 minutes and after an additional 60 minutes of stirring there is added 17 parts of an alkylated phenol.

To a 1 liter flask is added 495 parts of the above esterified product. The contents are heated to 140° C. and 337 parts Sunyl® 80 oil is added. Solvent is removed at 155° C. with nitrogen blowing at 1 cubic foot per hour. The final stripping conditions are 155° C. and 20 mm Hg. At 100° C. the contents are filtered using diatomaceous earth. The filtrate is a vegetable oil solution of the nitrogen-containing mixed ester having a nitrogen content of 0.14%.

Examples (E-10) and (E-11) employ an interpolymerizable monomer as part of the carboxy-containing interpolymer.

EXAMPLE (E-10)

One mole each of maleic anhydride and styrene and 0.05 moles methyl methacrylate are polymerized in toluene in the presence of benzoyl peroxide (1.5 parts) at 75°–95° C. The resulting interpolymer has a reduced specific viscosity of 0.13 and is a 12% slurry in toluene. Added to a 2 liter 4 neck flash is 868 parts (1 equivalent) of the polymer along with 68 parts (0.25 equivalents) oleyl alcohol, 55 parts (0.25 equivalents) Neodol 45, 55 parts (0.25 equivalents) Alfol 1218 and 36 parts (0.25 equivalents) Alfol 8–10. The contents are heated to 115° C. and added is 2 parts (0.02 moles) methanesulfonic acid. After a 2 hour reaction period, toluene is distilled off. With a neutralization number of 18.7 to phenolphthalein (indicating an 89% esterification), 15 parts (0.20 equivalents) n-butanol is added dropwise over 5 hours. The neutralization number/esterification level is 14.0/92.5%. Then added is 1.6 parts (0.02 moles) 50% aqueous sodium hydroxide to neutralize the catalyst. This is followed by the addition of 5.5 parts (0.038 equivalents) of aminopropylmorpholine and 400 parts Sunyl® 80 oil. The contents are vacuum stripped to 15 millimeters mercury at 100° C. and filtered using a diatomaceous earth filter aid. The filtrate is the product containing 0.18 percent nitrogen and 54.9 percent Sunyl® 80 oil.

The following example is similar to Example (E-10) but employs different alcohols and different levels in a different order of addition.

EXAMPLE (E-11)

Added to a 2 liter 4 neck flask is 868 parts (1 equivalent) of the polymer of Example (C-10), 9.25 parts (0.125 equivalents) isobutyl alcohol, 33.8 parts (0.125 equivalents) oleyl alcohol, 11 parts each (0.125 equivalents) of 2-methyl-1-butanol, 3-methyl-1-butanol and 1-pentanol, 23.4 parts (0.125 equivalents) hexyl alcohol, and 16.25 parts each (0.125 equivalents) 1-octanol and 2-octanol. At 110° C. 2 parts (0.02 moles) methanesulfonic acid is added. One hour later toluene is distilled off and when the distillation is complete, the neutralization number/esterification level is 5 62.5/70 percent. At 140° C. 31.2 parts (0.43 equivalents) n-butanol is added dropwise over 28 hours and the neutralization number/esterification level is 36.0/79.3 percent. At 120° C. 0.3 parts (0.03 moles) methanesulfonic acid is added followed by 20.4 parts (0.20 equivalents) hexyl alcohol. After esterification the neutralization number/esterification level is 10.5/95 percent. Then added is 1.9 parts (0.023 moles) 10 of 50% sodium hydroxide followed by 5.9 parts (0.04 equivalents aminopropylmorpholine and 400 parts Sunyl® 80 oil. The contents are filtered and the product has a nitrogen analysis of 0.18 percent.

Acrylate Polymers

In another aspect Component (E) is at least one hydrocarbon-soluble acrylate polymer of the formula

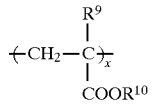

wherein $R^9$ is hydrogen or a lower alkyl group containing from 1 to about 4 carbon atoms, $R^{10}$ is a mixture of alkyl, cycloalkyl or aromatic groups containing from about 4 to about 24 carbon atoms, and x is an integer providing a weight average molecular weight (Mw) to the acrylate polymer of about 5000 to about 1,000,000.

Preferably $R^9$ is a methyl or ethyl group and more preferably, a methyl group. $R^{10}$ is primarily a mixture of alkyl groups containing from 4 to about 18 carbon atoms. In one embodiment, the weight average molecular weight of the acrylate polymer is from about 50,000 to about 500,000 and in other embodiments, the molecular weight of the polymer may be from 100,000 to about 500,000 and 300,000 to about 500,000.

Specific examples of the alkyl groups $R^{10}$ which may be included in the polymers of the present invention include, for example, n-butyl, octyl, decyl, dodecyl, tridecyl, octadecyl, hexadecyl, octadecyl. The mixture of alkyl groups can be varied so long as the resulting polymer is hydrocarbon-soluble.

The following examples are illustrative of the preparations of the acrylate polymers of the present invention. All parts and percentages are by weight unless indicated to the contrary.

EXAMPLE (E-12)

Added to a 2 liter 4 neck flask is 50.8 parts (0.20 moles) lauryl methacrylate, 44.4 parts (0.20 moles) isobornyl methacrylate, 38.4 parts (0.20 moles) 2-phenoxy ethyl acrylate, 37.6 parts (0.20 moles) 2-ethylhexyl acrylate, 45.2 parts (0.20 moles) isodecyl methacrylate and 500 parts toluene. At 100° C. 1 parts Vazo® 67 (2,2' azobis(2-methylbutyronitrile)) in 20 parts toluene is added over 7 hours. The reaction is held at 100° C. for 16 hours after which the temperature is increased to 120° C. to remove toluene and added is 216 parts of Sunyl® 80 oil. Volatiles are removed by vacuum distillation at 20 millimeters mercury at 140° C. The contents are filtered to give the desired product.

EXAMPLE (E-13)

Added to a 2 liter 4 neck flask is 38.1 parts (0.15 moles) lauryl methacrylate, 48.6 parts (0.15 moles) stearyl acrylate, 28.2 parts (0.15 moles) 2-ethylhexyl methacrylate, 25.5 parts (0.15 moles) tetrahydrofurfuryl methacrylate, 33.9 parts (0.15 moles) isodecyl methacrylate and 500 parts toluene. At 1 00° C. 1 part Vazo® 67 in 20 parts toluene is added dropwise in 6 hours. After the addition is complete, the reaction mixture is held at 100° C. for 15.5 hours, toluene is distilled out and 174 parts Sunyl® 80 oil is added. The contents are vacuum stripped at 140° C. at 20 millimeters of mercury and filtered to give the desired product.

An example of a commercially available methacrylate ester polymer which has been found to be useful in the present invention is sold under the tradename of "Acryloid 702" by Rohm and Haas, wherein $R^{10}$ is predominantly a mixture of n-butyl, tridecyl, and octadecyl groups. The weight average molecular weight (Mw) of the polymer is about 404,000 and the number average molecular weight ($\overline{M}n$) is about 118,000. Another commercially available methacrylate polymer useful in the present invention is available under the tradename of "Acryloid 954" by Rohm and Haas, wherein $R^{10}$ is predominantly a mixture of n-butyl, decyl, tridecyl, octadecyl, and tetradecyl groups. The weight average molecular weight of Acryloid 954 is found to be about 440,000 and the number average molecular weight is about 11 1,000. Each of these commercially available methacrylate polymers is sold in the form of a concentrate of about 40% by weight of the polymer in a light-colored mineral lubricating oil base. When the polymer is identified by the tradename, the amount of material added is intended to represent an amount of the commercially available Acryloid material including the oil.

Other commercially available polymethacrylates are available from Rohm and Haas Company as Acryloid 1253, Acryloid 1265, Acryloid 1263, Acryloid 1267, from Rohm GmbH as Viscoplex 0-410, Viscoplex 10-930, Viscoplex 5029, from Societe Francaise D'Organo-Synthese as Garbacryl T-84, Garbacryl T-78S, from Texaco as TLA 233, TLA 5010 and TC 10124. Some of these polymethacrylates may be PMA/OCP (olefin copolymer) type polymers.

Methylene Linked Aromatic Compounds

Another PPD having utility in this invention is a mixture of compounds having the general structural formula:

$$Ar\text{-}(R^{11})\text{-}X_n\text{-}[Ar'(R^{12})]_n\text{-}Ar''$$

wherein the Ar, Ar' and Ar" are independently an aromatic moiety containing 1 to 3 aromatic rings and each aromatic moiety is substituted with 0 to 3 substituents (the preferred aromatic precursor being naphthalene), $R^{11}$ and $R^{12}$ are independently straight or branch chain alkylenes containing 1 to 100 carbon atoms, n is 0 to 1000, n' is 0 or 1 and X is a hydrocarbylene group containing from 1 up to 24 carbon atoms.

This PPD is characterized by the presence of compounds over a wide molecular weight range, generally from about 300 to about 300,000 and preferably from about 300 to about 10,000. The molecular weight of compounds in the composition of the invention could vary from that of a simple unsubstituted benzene to a polymer of 1000 monomers of trisubstituted naphthalenes linked by alkylenes containing as many as 100 carbon atoms with the substituents of the naphthalene containing 1 to 50 carbon atoms.

The substituents for the aromatic moieties are obtained from olefins and/or chlorinated hydrocarbons.

The useful olefins include 1-octene, 1-decene, and alpha-olefins of chain lengths $C_{12}$, $C_{14}$, $C_{16\text{-}18}$, $C_{15\text{-}20}$, $C_{20\text{-}24}$, $C_{24\text{-}28}$. More preferably the invention process is carried out with olefins which are mixtures of the above. A good example would be the $C_{15\text{-}20}$ cracked wax olefins, or a mixture of 1-octene and $C_{16\text{-}18}$ alpha olefin.

The chlorinated hydrocarbons might contain from 1–50 carbon atoms and from about 2 to about 84% chlorine by weight. Preferred chlorinated hydrocarbons are obtained by chlorinating slack waxes or paraffinic waxes of $C_{18\text{-}30}$ chain length so that they contain from 5–50% chlorine by weight. A particularly preferred chlorinated hydrocarbon, being one of about 24 carbons containing about 2.5 chlorines per 24 carbon atoms.

Although Ar, Ar' and Ar" may be any aromatic containing 1 to 3 aromatic rings, it is preferable if Ar, Ar' and Ar" are all the same. Further, it is preferable if Ar, Ar' and Ar" are fused benzene rings, i.e., when two or three benzene rings are present, the adjoining rings share two carbon atoms. Most preferably, Ar, Ar' and Ar" are all derived from naphthalene.

Aromatics which might be precursors of Ar, Ar' and Ar" include benzene, biphenyl, diphenylmethane, triphenylmethane, aniline, diphenylamine, diphenylether, phenol, naphthalene, anthracene and phenanthrene. Naphthalene is particularly preferred.

Although the aromatic groups of the general formula above can contain 0 to 3 substituents, the composition will contain compounds with one or two substituents and will preferably include compounds with two substituents. The substituents may be derived from any olefin (preferably an alpha olefin containing 8 to 30 carbon atoms) or derived from a chlorinated hydrocarbon containing 8 to 50 carbon atoms (preferably a chlorinated hydrocarbon derived from a hydrocarbon wax containing 22–26 carbon atoms). In addition to or in place of forming the substituents, the olefin and/or chlorinated hydrocarbon may form the alkylene linking group ($R^{11}$ and $R^{12}$ groups) of the general structural formula. Compositions of the invention might include compounds wherein each of the naphthalene groups is substituted with one alkyl group containing 16 to 18 carbon atoms and one derived from a chlorinated hydrocarbon containing about 24 carbon atoms with about 2.5 chlorine atoms present for each 24 carbon atoms.

The desired material is a mixture of products which include alkylated naphthalenes, coupled and bridged naphthalenes, oligomers and dehydrohalogenated waxes. The Mw distribution of the final product is a more useful characterization of the final product. A useful Mw range is from 300–300,000. A more useful Mw range is from 300 to 112,000. A preferred distribution is from 400 to 112,000. The most useful distribution is from about 400 to about 112,000.

A disclosure on how to prepare methylene linked aromatic compounds can be found in U.S. Pat. No. 4,753,745. A typical procedure for the preparation of methylene linked aromatic compound is disclosed as Example C-14. U.S. Pat. No. 4,753,745 is hereby incorporated by reference for its disclosure to the methylene linked aromatic compounds.

EXAMPLE (E-14)

Naphthalene is mixed with seven parts of $CH_2Cl_2$ and 0.2 parts of $A1Cl_3$. chlorinated hydrocarbon (2.7 parts) is added slowly into the reaction mixture at 15° C. the reaction mixture is held for 5 hours at ambient temperature or until the release of HCl is complete. The mixture is then cooled to about 5° C. and 7.3 parts of an alpha olefin mixture is added over 2 hours while maintaining the temperature of the reaction mixture between 0° and 10° C.

The catalyst is decomposed by the careful addition of 0.8 parts 50% aqueous NaOH. The aqueous layer is separated and the organic layer is purged with $N_2$ and heated to 140° C. and 3mm Hg to remove the volatiles. The residue is filtered to yield 97% of the theoretical yield weight of the product.

Nitrogen-Containing Polyacrylate Esters

Component (E) may also be a nitrogen-containing polyacrylate ester prepared by reacting an acrylate ester of the formula

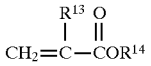

wherein $R^{13}$ is hydrogen or an alkyl group containing from 1 to about 8 carbon atoms and $R^{14}$ is an alkyl, cycloalkyl or aromatic group containing from 4 to about 24 carbon atoms with a nitrogen containing compound. For each mole of the acrylate ester from 0.001–1.0 moles of the nitrogen containing compound is employed. The reaction is carried out at a temperature of from 50° C. up to about 250° C. Non-limiting examples of nitrogen containing compounds are 4-vinylpyridine, 2-vinylpyridine, 2-N-morpholinoethyl methacrylate, N,N-dimethylaminoethyl methacrylate, and N,N-dimethylaminopropyl methacrylate.

The following example is illustrative of the preparation of the nitrogen-containing polymethacrylate. All parts and percentages are by weight unless indicated otherwise.

EXAMPLE (E-15)

Added to a 2 liter 4 neck flask is 50.8 parts (0.2 moles) lauryl methacrylate, 44.4 parts (0.20 moles) isobornyl methacrylate, 38.4 parts (0.20 moles) 2-phenoxyethyl acrylate, 37.6 parts (0.20 moles) 2-ethylhexyl acrylate, 45.2 parts (0.20 moles) isodecyl methacrylate, 21 parts (0.20 moles) 4-vinylpyridine and 500 parts toluene. At 100° C. 1 part Vazo 67 in 20 parts toluene is added dropwise in 8 hours. After maintaining the temperature at 100° C. for an additional 20 hours, an additional 0.5 parts Vazo 67 in 10 parts toluene is added in 3 hours. Toluene is then removed by distillation, 235 parts Sunyl® 80 is added and the contents are vacuum stripped to 25 millimeters mercury at 140° C. The contents are filtered to give a product with 0.71 percent nitrogen.

A few companies that make nitrogen-containing polyacrylates are Rohm and Haas, Rohm GmbH, Texaco, Albright & Wilson, Societe Francaise and D'Organo-Synthese (SFOS).

Terpolymers of a Fumarate, Vinyl Ester and Vinyl Ether

The final PPD having utility in this invention is a terpolymer of dialkylfiunarates, vinyl esters of fatty acids and alkyl vinyl ethers. The terpolymer has a specific viscosity of from 0.090 to 0.800 measured in a solution of 5 grams of terpolymer per 100 milliliters of benzene at 30° C., prepared by the process of polymerizing at a temperature of from about 25° C. to 150° C., a mixture of (a) one mole of a fumarate of the formula

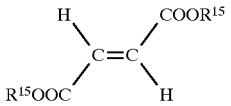

wherein $R^{15}$ is an alkyl group containing from 10 to 18 carbon atoms and from 0.5 to 1 mole of a mixture of (b) a vinyl ester of the formula $CH_2{=}CHOOR^{16}$ wherein $R^{16}$ is an alkyl group containing from 2 to 10 carbon atoms, and (c) a vinyl ether of the formula $CH_2{=}CHOR^{17}$ wherein $R^{17}$ is an alkyl group containing from 1 to 10 carbon atoms, the mole ration of (b) to (c) in the mixture being within the range of from 9:1 to 1:9.

The dialkyl fumarates which are useful in the preparation of the terpolymers are easily obtained by the esterification of fumaric acid with an alcohol $R^{15}OH$ wherein $R^{15}$ contains from about 10 to 18 carbon atoms and preferably from 12 to 14 carbon atoms. The usual esterification conditions are employed. However, any of the common methods of producing the desired esters (e.g., ester interchange) may be employed since the method of preparing the esters is not critical.

As mentioned previously, the alcohols which are useful in the preparation of the dialkyl fumarates are those having from 10 to 18 carbon atoms such as decyl ($C_{10}$), dodecyl ($C_{12}$), tetradecyl ($C_{14}$), hexadecyl ($C_{17}$), and octadecyl ($C_{18}$) alcohol. In addition to the individual alcohols, mixtures of two or more alcohols having an average number of carbon atoms ranging from about 10 to about 18 carbon atoms and preferably averaging from about 12 to 14 carbon atoms may also be employed in the preparation of the dialkyl fumarate. Suitable commercially available mixed alcohols are those obtained by the hydrogenation of natural oils such as coconut oil and tallow. One of the preferred commercially available alcohol mixtures consists of 2% decyl alcohol, 65% dodecyl alcohol, 26% tetradecyl alcohol, and 7% hexadecyl alcohol. Alcohols or alcohol mixtures containing an average from 12 to 14 carbon atoms are especially preferred since the terpolymers obtained from dialkyl fumarates containing from 12 to 14 carbon atoms in the alkyl group possess superior oil solubility and pour point depressing characteristics.

The second reactant which is utilized in the preparation of the terpolymers is a vinyl ester of a fatty acid wherein the $R^{16}$ group contains from about 2 to 10 carbon atoms, preferably from 2 to 6 carbon atoms and most preferably $R^{16}$ contains 2 carbon atoms. Examples of such vinyl esters include vinyl acetate, vinyl butyrate, vinyl hexanoate, and vinyl octanoate. Although any of the above esters may be utilized, vinyl acetate is preferred.

The third reactant which is utilized in the preparation of the terpolymers is an alkyl vinyl ether wherein the alkyl group $R^{17}$ contains from about 1 to 10 carbon atoms. Examples of such vinyl ethers include methyl vinyl ether, ethyl vinyl ether, iso-butyl vinyl ether, and n-butyl vinyl ether. Preferably $R^{17}$ is an ethyl group and the preferred vinyl ether is ethyl vinyl ether.

In general, from about 0.5 to about 1 mole of a mixture of the vinyl ester of (b) and the alkyl vinyl ether of (c) will be utilized per mole of the dialkyl fumarate of (a) in the monomer mixture. The preferred molar ratio of (a) to the mixture of (b) and (c) is 1:1 since the terpolymers obtained from such a mixture are characterized by superior oil solubility. The molar ratio of vinyl ester (b) to alkyl vinyl ether (c) may vary within the range of from about 9:1 to 1:9. The preferred range is from about 4:1 to 1:4. Examples of molar ratios of reactants (a), (b), and (c) which are contemplated as being useful in the monomer mixture include 1:0.6:0.4, 1:0.8:0.2, 1:0.9:0.1, 1:0.2:0.8, 1:0.1:0.9, and 1:0.3:0.4

The polymerization of the three reactants is carried out by mixing and heating the reactants with or without a solvent or diluent in the presence of a small amount of a catalyst at a temperature of from about 25° C. to about 150° C., preferably from about 25° C. to about 100° C. Since the polymerization is exothermic, cooling may be required to maintain the reaction mixture at the desired temperature. It is often convenient to add one of the reactants to a mixture of the other two reactants in order to control the rate of the polymerization reaction. Generally, the vinyl ester and alkyl vinyl ether are mixed and added slowly to the fumarate-catalyst mixture.

The polymerization is carried out in the presence of a small amount of a catalyst such as an organic peroxide or azobis-isobutyronitrile. Organic peroxides such as benzoyl peroxide and chlorobenzoyl peroxide are especially useful. Generally, from about 0.01 to about 1.5% of the catalyst is used.

The reaction time will vary from about 1 to 30 hours depending on the temperature, the reactivity of the monomers, and other reaction conditions.

The exact nature of the terpolymer is not fully understood. It is observed, however, that the properties of the polymers are dependent on the choice of monomer ratios. Thus the composition of the terpolymer is controlled by such choice but the precise chemical composition remains unknown.

The terpolymers may be characterized by the specific viscosity of a solution of 5 grams of a terpolymer and 100 ml. of benzene at 30° C. It is well known that the specific viscosity of a polymer solution is an indication of the molecular weight of that polymer.

The specific viscosity is defined by the formula $$\frac{\text{viscosity of the polymer solution}}{\text{viscosity of the pure solvent}} \text{ minus } 1$$

Solutions containing 5 grams of the terpolymers of this invention per 100 ml. of benzene are characterized by specific viscosities (at 30° C.) of from 0.090 to 0.800.

The following examples illustrate the methods of preparing the terpolymers of this invention.

EXAMPLE (E-16)

A mixture of 2340 parts (12 moles) of a commercial mixture of fatty alcohols consisting of 2% decyl alcohol, 65% of dodecyl alcohol, 26% of tetradecyl alcohol and 7% of hexadecyl alcohol, 300 parts of toluene, and 12.5 parts of para-toluenesulfonic acid is prepared and 696 parts (6 moles) of fumaric acid is added to the mixture. The esterification is accomplished by heating the mixture at reflux temperature for a period of 6 hours while removing the water as formed. Calcium hydroxide (30 parts) and 50 parts of a filter aid are added to the mixture which is heated to 110° C. for 1 hour and filtered. The filtrate is heated to 145° C./30 mm. to remove the volatile components. The residue is the desired dialkyl fumarate having a saponification number of 231 (theory, 238).

A mixture of 25 parts (0.3 mole) of vinyl acetate and 14 parts (0.2 mole) of ethyl vinyl ether is added dropwise to a mixture of 254 parts (0.5 mole) of the above-prepared dialkyl fumarate, warmed to 37° C., and the 1.5 parts of azobisisobutyronitrile is added. The mixture is then heated to 85° C. and maintained at a temperature of from 60° C.–70° C. for 10 hours. The volatile components are removed by heating at 135° C./40 mm. The residue is the desired terpolymer having a specific viscosity in benzene solution of 0.295.

EXAMPLE (E-17)

A mixture of 34.4 parts (0.4 mole) of vinyl acetate in 7.2 parts (0.10 mole) of ethyl vinyl ether is added dropwise to 237 parts (0.5 mole) of a dialkyl fumarate prepared as in Example (E-16) (saponification number of 231) in an atmosphere of nitrogen at a temperature of from 41°–44° C. There is then added 1.4 parts of azobis-isobutyronitrile and some polymerization occurs after about 5 hours. After an additional 8 hours of heating, 2 parts of chloroben7yl peroxide is added and the reaction mixture maintained at a temperature of from 50°–60° C. for 1 hour. The mixture is then heated to 80° C. at 20 mm Hg to remove any volatile material, a filter aid is added, and the mixture filtered at a temperature of 130° C. The filtrate is the desired terpolymer having a specific viscosity in benzene solution of 0.524.

EXAMPLE (E-18)

A mixture of 17.2 parts (0.2 mole) of vinyl acetate and 21.6 parts (0.3 mole) of ethyl vinyl ether is added over a period of 5 minutes to 237 parts (0.5 mole) of a dialkyl fumarate prepared as in Example (E-16) (saponification number 218) at a temperature of 28° C. There is then added 1.4 parts of azobisisobutyronitrile and the mixture is heated to 55°–60° C. The mixture is maintained at a temperature of from 55°–60° C. for 3 hours and filtered using a filter aid. The filtrate is the desired terpolymer having a specific viscosity in benzene solution of 0.358.

EXAMPLE (E-19)

A mixture of 8.6 parts (0.1 mole) of vinyl acetate and 28.8 parts (0.40 mole) of ethyl vinyl ether is added dropwise to 237 parts (0.50 mole) of the dialkyl fumarate prepared in Example (E-17) at a temperature of 40° C. in an atmosphere of nitrogen. The reaction is slightly exothermic and the mixture is maintained at a temperature of 50°–60° C. for 15 hours. The mixture is then heated at 160° C./15 mm. to remove any volatile materials. A filter aid is added and the mixture filtered at a temperature of 82° C. The filtrate is the desired terpolymer having a specific viscosity in a benzene solution of 0.183.

EXAMPLE (E-20)

Vinyl acetate (40 parts, 0.46 mole) is added to 380 parts (0.75 mole) of a dialkyl fumarate prepared according to the procedure of Example (E-16) (saponification number of 236) at a temperature of 40°–42° C. followed by the addition of 22 parts (0.31 mole) of ethyl vinyl ether and 4.4 parts of benzoyl peroxide. The mixture is heated to 66° C. in 45 minutes and is maintained at that temperature for 6.5 hours. Mineral oil (221 parts) is then added and the solution is reheated to 66° C. and filtered. The filtrate is the desired terpolymer solution (33.3% oil) having a specific viscosity measured in benzene solution of 0.390.

EXAMPLE (E-21)

The procedure of Example (E-16) is repeated using 215 parts (0.5 mole) of a dialkyl fumarate prepared by reacting 1 mole of fumaric acid with 2 moles of a commercial mixture of fatty alcohols consisting of 2.5% decyl alcohol, 95.0% of dodecyl alcohol, and 2.5% of tetradecyl alcohol, 34.3 parts (0.3 mole) of vinyl butyrate, 14.4 parts (0.2 mole) of ethyl vinyl ether and 1.5 parts of benzoyl peroxide as catalyst.

Enhanced biodegradable greases are prepared by mixing together components (A) and (B). Component (C) is formed in situ from the reaction of components (C1) and (C2). An additional solution of components (A) and (B) may be added after the formation of component (C).

In obtaining the composition of this invention, two different processes are envisioned. In the first process, a grease is prepared that involves the steps of (a) making a solution of (A) a base oil and (B) a performance additive or (A) a base oil, (B) a performance additive, (D) a viscosity modifier and/or (E) a pour point depressant with (C1) a metal based material and (C2) a carboxylic acid or its ester, wherein the equivalent ratio of (C1):(C2) is from about 1:0.70–1.10 and wherein the weight ratio of base oil (A) to the sum of the metal based material and carboxylic acid is from 50:50 to 95:5, thereby providing a mixture;

(b) heating said mixture to a temperature of from 82° C. to about 105° C. to form (C) a thickener;

(c) heating the mixture to a final temperature of about 145° C. for an alkaline metal or to about 200° C. for an alkali metal; and (d) cooling the mixture to form a grease.

The second process of this invention involves the steps of (a) making a solution of (A) a base oil and (B) a performance additive, or (A) a base oil, (B) a performance additive, (D) a viscosity modifier and/or (E) a pour point depressant with (C1) a metal based material and (C2) a carboxylic acid or its ester, wherein the equivalent ratio of (C1):(C2) is from about 1:0.70–1.10 and wherein the weight ratio of base oil (A) to the sum of the metal based material and carboxylic acid is from 50:50 to 90:10, thereby providing a first mixture;

(b) heating said first mixture to a temperature of from 82° C. to about 105° C. to form (C) a thickener thereby providing a first heated mixture;

(c) heating the first heated mixture to a final temperature of about 145° C. for an alkaline earth metal or to about 200° C. for an alkali metal;

(d) adding at 110°–145° C. for an alkaline earth metal or 170°–200° C. for an alkali metal, subsequent portions of (A) the base oil or the solution of (A) the base oil and (B) the performance additive or (A) the base oil, (B) the performance additive, (D) the viscosity modifier and/or (E) the pour point depressant such that the total weight ratio of base oil (A) to the sum of the metal based material (C1) and carboxylic acid or its ester (C2) is from 50:50 to 95:5 to provide a second mixture; and (e) permitting this mixture to cool to form a grease.

In the above processes, the total percent weight of performance additive (B) in the grease is from 0.5 to 10, preferably from 1 to 6 and most preferably from 1.25 to 3. The total percent weight of the viscosity modifier (D) in the grease is from 0.5 to 7.5, preferably from 0.75 to 5 and most preferably from 1 to 3. The total percent weight of the pour point depressant (E) in the grease is from 0.5 to 7.5, preferably 0.75 to 5 and most preferably from 1 to 3.

In the above processes, (A), (B), (C1), (C2), (D) and (E) are as earlier defined.

EXAMPLE 1

A blend of Sunyl 80 oil and additives are prepared as follows: 24,244 parts Sunyl 80 oil, 762 parts Glissoviscal PGE available from BASF, 190.5 parts nonylated diphenylamine, 190.5 parts 2,6-di-t-butylphenol and 12.7 parts tolytriazole. The oil is heated to 70° C. and the additives are added and stirred until a uniform solution is obtained.

Added to a Hobart mixer are 1,270 parts of the above blended oil, and 240 parts (0.8 equivalents) of 12-hydroxystearic acid. The contents are heated and stirred and at 77° C. 32.8 parts (0.88 equivalents) of calcium hydroxide is added. The temperature is slowly increased to 140° C. and held at this temperature for 0.5 hours. With the heat turned off, 457.2 parts of the blended oil is added. A grease forms at about 60° C. and the contents are milled.

EXAMPLE 2

A blend of rapeseed oil and additives are prepared as follows: 25,006 parts rapeseed oil, 190.5 parts nonylated diphenylamine, 190.5 parts 2,6-di-t-butylphenol and 12.7 parts tolytriazole. The oil is heated to 70° C. and the additives are added and stirred until a uniform solution is obtained.

Following the procedure of Example 1, a grease is prepared utilizing the blended rapeseed oil in place of the blended Sunyl 80 oil.

EXAMPLE 3

Added to a Hobart mixer is 1,400 parts of the blended rapeseed oil of Example 2 and 195 parts (0.65 equivalents) of 12-hydroxystearic acid. The contents are heated to 77° C. and a mixture of 35 parts (0.83 equivalents) lithium hydroxide monohydrate in 80 parts water is slowly added. The temperature is increased to 103° C. while removing water. The contents are slowly heated to 195° C. and held at this temperature for 10 minutes. The heat is turned off and 370 parts of the blended rapeseed oil is added. A grease forms upon cooling and the contents are milled.

EXAMPLE 4

Added to a Hobart mixer is 1,587.4 parts of the blended Sunyl 80 oil of Example 1 and 258 parts (0.86 equivalents) of 12-hydroxystearic acid. The contents are heated to 77° C. and a mixture of 46.2 parts (1.1 equivalents) of lithium hydroxide monohydrate in 80 parts water is slowly added. The temperature is increased to 103° C. while removing water. The contents are slowly heated to 175° C. and held at this temperature for 30 minutes. The heat is turned off and 108 parts of the blended Sunyl 80 oil is added. A grease forms upon cooling and the contents are milled.

EXAMPLE 5

An oil blend is prepared as per the procedure and proportions of the rapeseed oil blend of Example 2 except that the rapeseed oil is substituted with Sunyl 80 oil to give a Sunyl 80 oil blend. The procedure of Example 1 is repeated utilizing this Sunyl 80 oil blend and a grease composition is prepared.

EXAMPLE 6

The procedure of Example 5 is essentially followed except that the water is omitted.

The grease compositions of this invention are evaluated in the following tests: unworked penetration, $P_0$; worked penetration, $P_{60}$ and $P_{10K}$; dropping point; weld point and wear. Several of the above prepared greases have the following characteristics as shown in Table 1.

TABLE I

| Grease Characteristics | | | | | |
|---|---|---|---|---|---|
| Test/Example | 1 | 2 | 3 | 4 | 5 |
| $P_0$ | 243 | 255 | 389 | 275 | 236 |
| $P_{60}$ | 255 | 254 | 384 | 279 | 260 |
| $P_{10K}$ | 276 | 392 | 378 | 284 | 301 |
| Dropping Point (°C.) | 106 | 106 | 183 | 200 | 102 |
| Weld Point (Kg) | 160 | 160 | 100 | 160 | 160 |
| Wear (mm) | 0.50 | 0.50 | 0.63 | 0.50 | 0.50 |

What is claimed is:

1. An environmentally friendly lubricating grease, comprising;

(A) a natural base oil wherein the natural oil is a genetically modified vegetable oil triglyceride of the formula

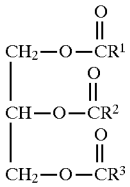

wherein $R^1$, $R^2$ and $R^3$ are aliphatic groups that contain from about 7 to about 23 carbon atoms and have a monounsaturated character of at least 60 percent;

(B) at least one performance additive comprising (1) an alkyl phenol of the formula

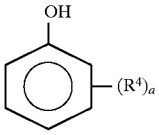

wherein $R^4$ is an alkyl group containing from 1 up to about 24 carbon atoms and a is an integer of from 1 up to 5;

(2) a benzotriazole of the formula

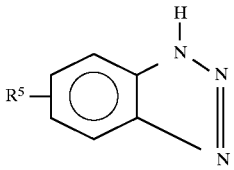

wherein $R^5$ is hydrogen or an alkyl group of 1 up to about 24 carbon atoms; or (3) an aromatic amine of the formula

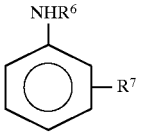

wherein $R^6$ is

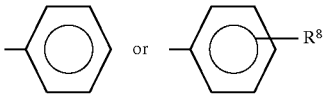

and $R^7$ and $R^8$ are independently a hydrogen or an alkyl group containing from 1 up to about 24 carbon atoms;

(C) a thickener wherein the thickener (C) is a reaction product of (C1) a metal based material and (C2) a carboxylic acid or its ester, wherein the metal based material (C1) comprises a metal oxide, metal hydroxide, metal carbonate or metal bicarbonate, wherein the metal is an alkali or alkaline earth metal and wherein the carboxylic acid or its ester (C2) is of the formula $R^{18}(COOR^{19})_n$ wherein $R^{18}$ is an aliphatic group that contains from 4 to about 29 carbon atoms, $R^{19}$ is hydrogen or an aliphatic group that contains from 1 to 4 carbon atoms and n is an integer of from 1 to 4 and (D) a viscosity modifier wherein the viscosity modifier (D) is a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000.

2. The lubricating grease of claim 1 wherein within (B)(1) a is 2 and $R^4$ contains from 1 up to about 8 carbon atoms.

3. The lubricating grease of claim 2 wherein the alkyl phenol is of the formula

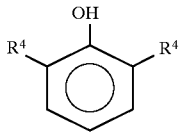

wherein $R^4$ is t-butyl.

4. The lubricating grease of claim 1 wherein within (B)(2) $R^5$ is hydrogen or an alkyl group containing from 1 up to about 8 carbon atoms.

5. The lubricating grease of claim 1 wherein within (B)(2) $R^5$ is a methyl group.

6. The lubricating grease of claim 1 wherein within (B)(3) $R^6$ is

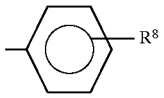

and $R^7$ and $R^8$ are alkyl groups containing from 4 to 18 carbon atoms.

7. The lubricating grease of claim 6 wherein within (B)(3) $R^7$ and $R^8$ are nonyl groups.

8. The lubricating grease of claim 1 wherein the alkali metals of (C1) comprise lithium, sodium or potassium.

9. The lubricating grease of claim 1 wherein the alkaline earth metals of (C1) comprise magnesium, calcium or barium.

10. The lubricating grease of claim 1 wherein (C1) is lithium hydroxide.

11. The lubricating grease of claim 1 wherein (C1) is calcium hydroxide.

12. The lubricating grease of claim 1 wherein within (C2), $R^{18}$ contains from 12 to 24 carbon atoms and n is 1 or 2.

13. The lubricating grease of claim 1 wherein $R^{19}$ is hydrogen and the carboxylic acid is a monocarboxylic acid.

14. The lubricating grease of claim 1 wherein $R^{19}$ is hydrogen and the carboxylic acid is a mono- or di-hydroxy monocarboxylic acid.

15. The lubricating grease of claim 13 wherein within (C2) the mono-hydroxy monocarboxylic acids comprise 6-hydroxystearic acid, 12-hydroxystearic acid, 14-hydroxystearic acid, 16-hydroxystearic acid, and ricinoleic acid.

16. The lubricating grease of claim 13 wherein (C2) is the di-hydroxy monocarboxylic acid comprising 9,10-dihydroxystearic acid.

17. The lubricating grease of claim 1 wherein the equivalent ratio of (C1):(C2) is from 1:0.70–1.10.

18. The lubricating grease of claim 1 wherein the monounsaturated character is due to an oleic acid residue wherein an oleic acid moiety:linoleic acid moiety ratio is from 2 up to 90.

19. The lubricating grease of claim 18 wherein the monounsaturated character is at least 70 percent.

20. The lubricating grease of claim 18 wherein the monounsaturated character is at least 80 percent.

21. The lubricating grease of claim 18 wherein the genetically modified vegetable oil comprises genetically modified sunflower oil, genetically modified corn oil, genetically modified soybean oil, genetically modified rapeseed oil, genetically modified canola oil, genetically modified safflower oil or genetically modified peanut oil.

22. The lubricating grease of claim 1 wherein said normal block copolymer has a total of two or three polymer blocks, wherein the number average molecular weight of said normal block and said random copolymer is from about 30,000 to about 200,000, wherein in said block copolymer the total amount of said conjugated diene is from about 40% to about 60% by weight and the total amount of said vinyl substituted aromatic is from about 40% to about 60% by weight.

23. The lubricating grease of claim 22 wherein said conjugated diene is isoprene or butadiene, wherein said vinyl substituted aromatic is styrene, and wherein said hydrogenated normal block copolymer and random block copolymer contain no more than 0.5% residual olefinic unsaturation.

24. A process for preparing an environmentally friendly grease comprising the steps of (a) making a solution of (A) a natural base oil wherein the natural oil is a genetically modified vegetable oil triglyceride of the formula

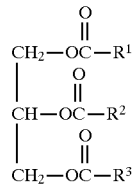

wherein $R^1$, $R^2$ and $R^3$ are aliphatic groups that contain from about 7 to about 23 carbon atoms and have a monounsaturated character of at least 60 percent; and (B) at least one performance additive comprising (1) an alkyl phenol of the formula

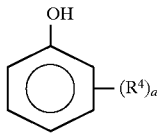

wherein $R^4$ is an alkyl group containing from 1 up to about 24 carbon atoms and a is an integer of from 1 up to 5;

(2) a benzotriazole of the formula

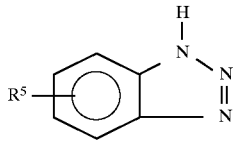

wherein $R^5$ is hydrogen or an alkyl group of 1 up to about 24 carbon atoms; or (3) an aromatic amine of the formula

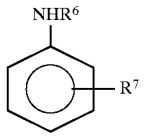

wherein $R^6$ is

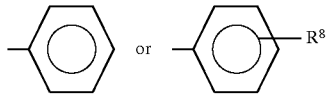

and $R^7$ and $R^8$ are independently a hydrogen or an alkyl group containing from 1 up to about 24 carbon atoms; and (D) a viscosity modifier wherein the viscosity modifier is a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000; or (A) the base oil;

(B) the performance additive; and (E) a pour point depressant comprising an ester characterized by low-temperature modifying properties of an ester of a carboxy-containing interpolymer, said interpolymer having a reduced specific viscosity of from about 0.05 to about 2 and being derived from at least two monomers, one of said monomers being a low molecular weight aliphatic olefin, styrene or a substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity and being characterized by the presence within its polymeric structure of pendant polar groups which are derived from the carboxy groups of said ester:

(a) a relatively high molecular weight carboxylic ester group, said carboxylic ester group having at least 8 aliphatic carbon atoms in the ester radical, optionally (b) a relatively low molecular weight carboxylic ester group having no more than 7 aliphatic carbon atoms in the ester radical, wherein the molar ratio of (a):(b) of the pour point depressant when (b) is present is (1–20):1, and optionally (c) a carbonyl-amino group derived from an amino compound having one primary or secondary amino group, wherein the molar ratio of (a):(b):(c) of the pour point depressant when (b) and (c) are present is (50–100):(5–50):(0.1–15);

an acrylate polymer of the formula

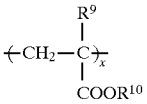

wherein $R^9$ is hydrogen or a lower alkyl group containing from 1 to about 4 carbon atoms, $R^{10}$ is a mixture of alkyl, cycloalkyl or aromatic groups containing from about 1 to about 24 carbon atoms, and x is an integer providing a weight average molecular weight (Mw) to the acrylate polymer of about 5000 to about 1,000,000;

a mixture of compounds having the general structural formula $$Ar\text{-}(R^{11})\text{-}X_n\text{-}[Ar'(R^{12})_n\text{-}Ar''$$

wherein the Ar, Ar' and Ar" are independently an aromatic moiety containing 1 to 3 aromatic rings and the mixture includes compounds wherein moieties are present with 0 substituents, 1 substituent, 2 substituents and 3 substituents, $R^{11}$ and $R^{12}$ are independently an alkylene containing about 1 to 100 carbon atoms, n is 0 to 1000, n' is 0 or 1 and X is a hydrocarbylene group containing from 1 up to 24 carbon atoms;

a nitrogen containing polymer prepared by polymerizing an acrylate ester monomer of the formula

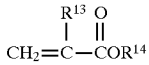

wherein $R^{13}$ is hydrogen or an alkyl group containing from 1 to about 8 carbon atoms and $R^{14}$ is an alkyl, cycloalkyl or aromatic group containing from 1 to about 30 carbon atoms with a nitrogen-containing monomer at from 0.001–1.0 moles of the nitrogen containing monomer for each mole of the acrylate ester monomer; or a terpolymer having a specific viscosity of from 0.090 to 0.800 measured in a solution of 5 grams of terpolymer per 100 milliliters of benzene at 30° C., prepared by polymerizing at a temperature of from 25° C. to 150° C., a mixture of (a) one mole of a fumarate of the formula

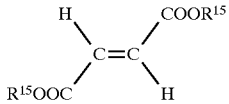

wherein $R^{15}$ is an alkyl group containing from 10 to 18 carbon atoms and from 0.5 to 1 mole of a mixture of (b) a vinyl ester of the formula $$CH2{=}CHOOR^{16}$$

wherein $R^6$ is an alkyl group containing from 2 to 10 carbon atoms, and (c) a vinyl ether of the formula $$CH_2{=}CHOR^{17}$$

wherein $R^{17}$ is an alkyl group containing from 1 to 10 carbon atoms, the mole ration of (b) to (c) in the mixture being within the range of from 9:1 to 1:9; or (A) the base oil;

(B) the performance additive;

(D) the viscosity modifier; and (E) the pour point depressant; and adding (C) a thickener wherein the thickener (C) is a reaction product of (C1) a metal based material and (C2) a carboxylic acid, or its ester wherein the metal based material (C1) comprises a metal oxide, metal hydroxide, metal carbonate or metal bicarbonate, wherein the metal is an alkali or alkaline earth metal and wherein the carboxylic acid (C2) is of the formula $R^{18}(COOR^{19})_n$ wherein $R^{18}$ is an aliphatic group that contains from 4 to about 29 carbon atoms, $R^{19}$ is hydrogen or an aliphatic group that contains from 1 to 4 carbon atoms and n is an integer of from 1 to 4, wherein the equivalent ratio of (C1):(C2) is from 1:0.70–1.10 and wherein the weight ratio of the base oil to the sum of the metal based material and the carboxylic acid is from 50:50 to 95:5, thereby providing a mixture; and (b) heating said mixture to a temperature of from about 82° C. to about 105° C. to form (C) the thickener;

(c) heating the mixture to a final temperature of about 145° C. for an alkaline metal or to about 200° C. for an alkali metal; and (d) cooling the mixture to form a grease wherein the performance additive (B) is present at from 0.5 to 10 percent by weight, and the viscosity modifier (D) is present at from 0.5 to 7.5 percent by weight.

25. A process for preparing an environmentally friendly grease comprising the steps of (a) making a solution of (A) a natural base oil wherein the natural oil is a genetically modified vegetable oil triglyceride of the formula

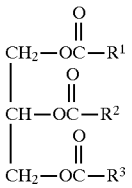

wherein $R^1$, $R^2$ and $R^3$ are aliphatic groups that contain from about 7 to about 23 carbon atoms and have a monounsaturated character of at least 60 percent; and (B) at least one performance additive comprising (1) an alkyl phenol of the formula

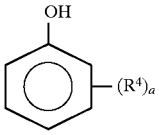

wherein $R^4$ is an alkyl group containing from 1 up to about 24 carbon atoms and a is an integer of from 1 up to 5;

(2) a benzotriazole of the formula

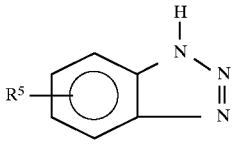

wherein $R^5$ is hydrogen or an alkyl group of 1 up to about 24 carbon atoms; or (3) an aromatic amine of the formula

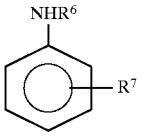

wherein $R^6$ is

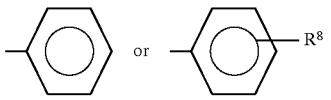

and $R^7$ and $R^8$ are independently a hydrogen or an alkyl group containing from 1 up to about 24 carbon atoms; and (D) a viscosity modifier wherein the viscosity modifier is a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000; or (A) the base oil;

(B) the performance additive; and (E) a pour point depressant comprising an ester characterized by low-temperature modifying properties of an ester of a carboxy-containing interpolymer, said interpolymer having a reduced specific viscosity of from about 0.05 to about 2 and being derived from at least two monomers, one of said monomers being a low molecular weight aliphatic olefin, styrene or a substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity and being characterized by the presence within its polymeric structure of pendant polar groups which are derived from the carboxy groups of said ester:

(a) a relatively high molecular weight carboxylic ester group, said carboxylic ester group having at least 8 aliphatic carbon atoms in the ester radical, optionally (b) a relatively low molecular weight carboxylic ester group having no more than 7 aliphatic carbon atoms in the ester radical, wherein the molar ratio of (a):(b) of the pour point depressant when (b) is present is (1–20): 1, and optionally (c) a carbonyl-amino group derived from an amino compound having one primary or secondary amino group, wherein the molar ratio of (a):(b):(c) of the pour point depressant when (b) and (c) are present is (50–100):(5–50):(0.1–15);

an acrylate polymer of the formula

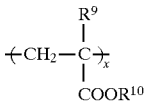

wherein $R^9$ is hydrogen or a lower alkyl group containing from 1 to about 4 carbon atoms, $R^{10}$ is a mixture of alkyl, cycloalkyl or aromatic groups containing from about 1 to about 24 carbon atoms, and x is an integer providing a weight average molecular weight (Mw) to the acrylate polymer of about 5000 to about 1,000,000;

a mixture of compounds having the general structural formula $$Ar\text{-}(R^{11})\text{-}X_n\text{-}[Ar'(R^{12})]_n\text{-}Ar''$$

wherein the Ar, Ar' and Ar" are independently an aromatic moiety containing 1 to 3 aromatic rings and the mixture includes compounds wherein moieties are present with 0 substituents, 1 substituent, 2 substituents and 3 substituents, $R^{11}$ and $R^{12}$ are independently an alkylene containing about 1 to 100 carbon atoms, n is 0 to 1000, n' is 0 or 1 and X is a hydrocarbylene group containing from 1 up to 24 carbon atoms;

a nitrogen containing polymer prepared by polymerizing an acrylate ester monomer of the formula

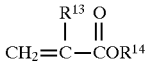

wherein $R^{11}$ is hydrogen or an alkyl group containing from 1 to about 8 carbon atoms and R is an alkyl, cycloalkyl or aromatic group containing from 1 to about 30 carbon atoms with a nitrogen-containing monomer at from 0.001–1.0 moles of the nitrogen containing monomer for each mole of the acrylate ester monomer; or a terpolymer having a specific viscosity of from 0.090 to 0.800 measured in a solution of 5 grams of terpolymer per 100 milliliters of benzene at 30° C., prepared by polymerizing at a temperature of from 25° C. to 150° C., a mixture of (a) one mole of a fumarate of the formula

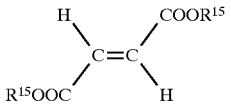

wherein $R^{15}$ is an alkyl group containing from 10 to 18 carbon atoms and from 0.5 to 1 mole of a mixture of (b) a vinyl ester of the formula $CH_2{=}CHOOR^{16}$ wherein $R^{16}$ is an alkyl group containing from 2 to 10 carbon atoms, and (c) a vinyl ether of the formula $CH_2{=}CHOR^{17}$ wherein $R^{17}$ is an alkyl group containing from 1 to 10 carbon atoms, the mole ration of (b) to (c) in the mixture being within the range of from 9:1 to 1:9; or (A) the base oil;

(B) the performance additive;

(D) the viscosity modifier; and (E) the pour point depressant; and adding (C) a thickener wherein the thickener (C) is a reaction product of (C1) a metal based material and (C2) a carboxylic acid or its ester, wherein the metal based material (C1) comprises a metal oxide, metal hydroxide, metal carbonate or metal bicarbonate, wherein the metal is an alkali or alkaline earth metal and wherein the carboxylic acid or its ester (C2) is of the formula $R^{18}(COOR^{19})_n$ wherein $R^{18}$ is an aliphatic group that contains from 4 to about 29 carbon atoms, $R^{19}$ is hydrogen or an aliphatic group containing from 1 to 4 carbon atoms and n is an integer of from 1 to 4, wherein the equivalent ratio of (C1):(C2) is from 1:0.70–1.10 and wherein the weight ratio of the base oil to the sum of the metal based material and the carboxylic acid is from 50:50 to 90:10, thereby providing a first mixture; and (b) heating said first mixture to a temperature of from about 82° C. to about 105° C. to form (C) a thickener thereby providing a first heated mixture;

(c) heating the first heated mixture to a final temperature of about 145° C. for an alkaline metal or to about 200° C. for an alkali metal;

(d) adding at 110°–145° C. for an alkaline earth metal or 170°–200° C. for an alkali metal, subsequent portions of (A) or the solution of (A) and (B) or (A), (B), and (D) such that the total weight ratio of base oil (A) to the sum of the metal based material (C1) and carboxylic acid (C2) is from 50:50 to 95:5 to provide a second mixture; and (e) permitting this mixture to cool to form a grease wherein the performance additive (B) is present at from 0.5 to 10 percent by weight, the viscosity modifier (D) is present at from 0.5 to 7.5 percent by weight.

* * * * *

UNITED STATES PATENT AND TRADEMARK OFFICE

CERTIFICATE OF CORRECTION

PATENT NO. : 5,858,934
DATED : January 12, 1999
INVENTOR(S) : Gary W. Wiggins, et al.

It is certified that error appears in the above-identified patent and that said Letters Patent is hereby corrected as shown below:

Column 31, line 11 delete "or".

Column 31, line 12 through column 32, line 44, should be deleted.

Column 32, line 45, delete "(E) the pour depresant;".

Column 34, line 17, delete "or".

Column 34, line 18 through column 36, line 10, should be deleted.

Column 36, line 11, delete "(E) the pour depressant;".

Signed and Sealed this

Fifteenth Day of June, 1999

*Attest:*

Q. TODD DICKINSON

*Attesting Officer*

*Acting Commissioner of Patents and Trademarks*